US009786167B2

(12) United States Patent
Mauro et al.

(10) Patent No.: US 9,786,167 B2
(45) Date of Patent: Oct. 10, 2017

(54) METHOD AND DEVICE FOR VALIDATING AN INFORMATION ITEM REGARDING A WRONG-WAY DRIVER

(71) Applicant: Robert Bosch GmbH, Stuttgart (DE)

(72) Inventors: Daniele Mauro, Bad Urach (DE); Kurt Eckert, Ditzingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/234,061

(22) Filed: Aug. 11, 2016

(65) Prior Publication Data

US 2017/0043718 A1 Feb. 16, 2017

(30) Foreign Application Priority Data

Aug. 12, 2015 (DE) ..... 10 2015 215 380

(51) Int. Cl.
*G08G 1/09* (2006.01)
*G08G 1/056* (2006.01)
*G08G 1/16* (2006.01)

(52) U.S. Cl.
CPC ..... *G08G 1/056* (2013.01); *G08G 1/164* (2013.01)

(58) Field of Classification Search
CPC ..... G08G 1/056
USPC ..... 340/905
See application file for complete search history.

(56) References Cited

U.S. PATENT DOCUMENTS

2008/0100473 A1* 5/2008 Gao ..... G08G 1/04 340/937
2011/0121992 A1* 5/2011 Konaka ..... B62D 15/029 340/905
2013/0044009 A1* 2/2013 Tagawa ..... G08G 1/075 340/995.28
2016/0225256 A1* 8/2016 Hofsaess ..... G08G 1/166
2017/0032668 A1* 2/2017 Al-Deek ..... G08G 1/056

* cited by examiner

*Primary Examiner* — Santiago Garcia
(74) *Attorney, Agent, or Firm* — Norton Rose Fulbright US LLP; Gerard Messina

(57) ABSTRACT

A method for validating an information item regarding a wrong-way driver, which indicates an instance of detected wrong-way travel of a vehicle driving the wrong way. The method includes checking plausibility, in which the information item regarding a wrong-way driver is checked for plausibility, using an additional information item, before the information item regarding a wrong-way driver is made available as a warning message for affected road users. In this context, the warning message is suppressed, if the additional information item characterizes the information item regarding a wrong-way driver as irrelevant.

20 Claims, 2 Drawing Sheets

Figure 1:
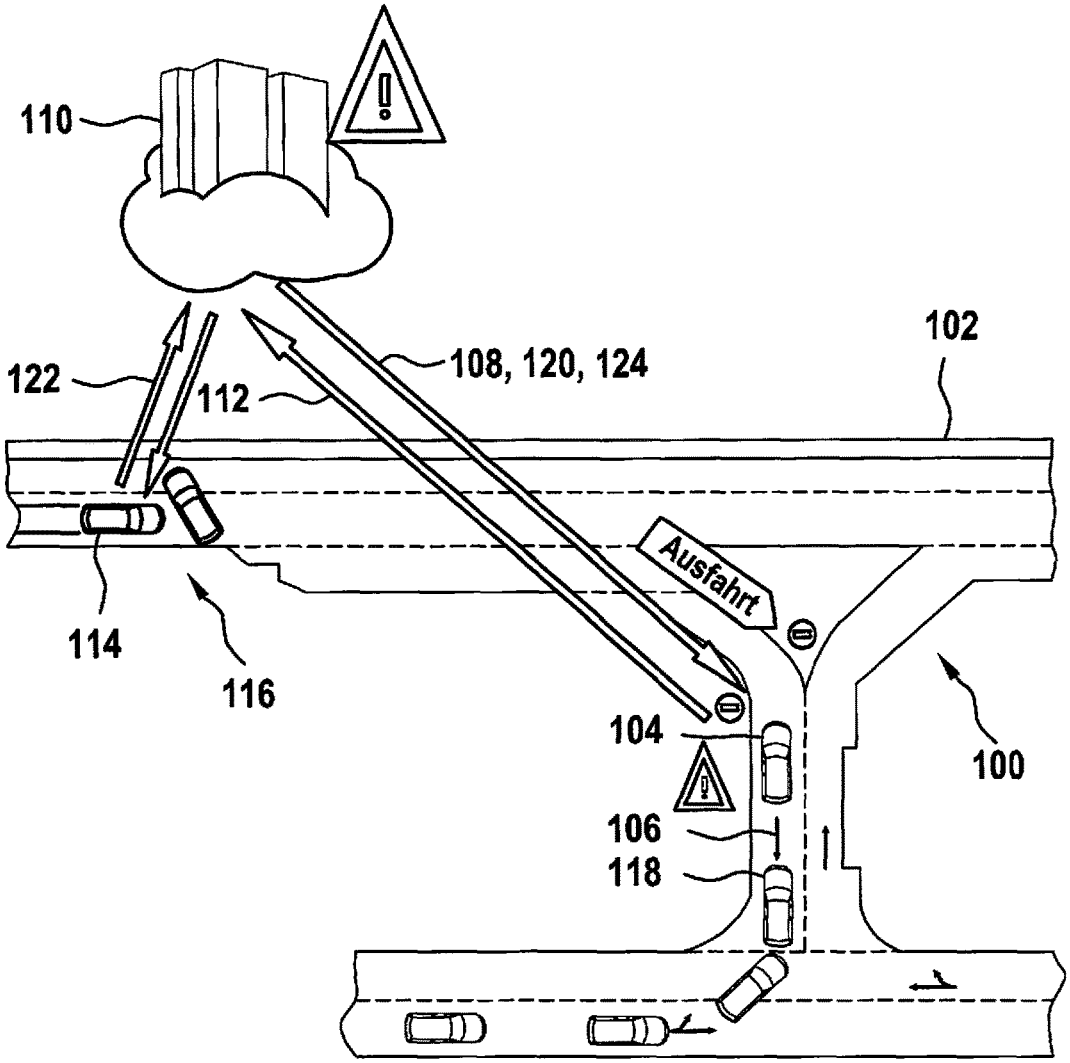

METHOD AND DEVICE FOR VALIDATING AN INFORMATION ITEM REGARDING A WRONG-WAY DRIVER

RELATED APPLICATION INFORMATION

The present application claims priority to and the benefit of German patent application no. 10 2015 215 380.0, which was filed in Germany on Aug. 12, 2015, the disclosure of which is incorporated herein by reference.

FIELD OF THE INVENTION

The present invention is based on a device or a method. The subject matter of the present invention also includes a computer program.

BACKGROUND INFORMATION

In the case of an accident, wrong-way drivers, who are also referred to as ghost drivers, cause deaths, injuries and considerable property damage. Detection on the basis of a navigation device alone, using, for example, a road class and a street direction, is too late in most cases; that is, the wrong-way driver is already on the wrong roadway at a high speed of travel and with a high probability of a collision. Drivers in the vicinity of a wrong-way driver may be warned, for example, via vehicle-to-vehicle communication or by mobile radio communication.

Over half of the instances of wrong-way driving begin at federal expressway exits. In particular, instances of wrong-way travel on expressways result in accidents at a high collision speed and, consequently, in serious injuries or injuries resulting in death.

SUMMARY OF THE INVENTION

Against this background, with the starting point introduced here, a method for validating an information item regarding a wrong-way driver is put forward, in addition, a device that uses this method, and finally, a corresponding computer program, in accordance with the main descriptions herein. The measures specified in the further descriptions herein render possible advantageous refinements and improvements of the device indicated in the main description herein.

In particular situations, such as modified traffic routing or an accident, it may be necessary to drive onto an expressway or a road similar to an expressway, in a direction opposite to the direction of travel. In response to entering in the wrong direction, an identification of a wrong-way driver is generated, in this case, an information item regarding a wrong-way driver, through which a warning message for other road users and the wrong-way driver himself or herself may be generated. However, under the particular circumstances, it is not desirable to send the warning message. This invalid warning message would only cause confusion.

Therefore, in the approach introduced here, the information item regarding a wrong-way driver is validated, using an additional information item. The warning message is only provided when the additional information item characterizes the information item regarding a wrong-way driver as relevant.

A method for validating an information item regarding a wrong-way driver is put forward, the information item regarding a wrong-way driver indicating a detected instance of wrong-way travel of a vehicle traveling the wrong way, and the method including a step of checking plausibility, in which the information item regarding a wrong-way driver is checked for plausibility, using an additional information item, before the information item regarding a wrong-way driver is made available as a warning message for affected road users, the warning message being suppressed if the additional information item characterizes the information item regarding a wrong-way driver as irrelevant.

An information item regarding a wrong-way driver may be understood as an information item regarding a vehicle traveling in the wrong direction, thus, in a direction opposite to a normal direction of travel. A warning message may include a request for action. For example, a warning message for the driver of a vehicle traveling in the wrong direction may include a request to stop the vehicle on the right edge of a roadway. A warning message for an endangered road user may include, for example, a request to drive in the right lane, a request to drive one behind the other, and a request not to pass.

The method may include a step of generating the additional information item, the additional information item being generated as characterizing irrelevancy, if the information item regarding a wrong-way driver and at least one further information item regarding a wrong-way driver have been detected within a predefined time window. More than one wrong-way driver within a short time is highly improbable. If several information items regarding a wrong-way driver are received one after the other, then it is highly probable that a special situation exists in which no warning message should be outputted.

The additional information item may be generated as indicating irrelevancy, if, in addition, the information items regarding a wrong-way driver have been detected, using the same methods for detecting a wrong-way driver. In particular, when the same device sounds off several times one after the other, it may be assumed that it is not a question of redundant information items regarding a wrong-way driver.

The additional information item may be generated as indicating irrelevancy, when, in addition, the information items regarding a wrong-way driver have been detected at the same location. If a large region is monitored, then it may be ruled out that in the improbable coincidence that two wrong-way drivers are detected simultaneously but at different locations, no warning message is supplied.

The additional information item may represent an information item regarding traffic. The traffic information item may characterize the information item regarding a wrong-way driver as irrelevant, when the information item regarding a wrong-way driver has been detected in a section of road, which has been identified by the traffic information item as having to be traveled on in a direction opposite to a normal direction of travel. In this manner, the changed traffic flow at, for example, a construction site may be taken into consideration.

The method may include a step of inputting, in which the additional information item is inputted by the vehicle traveling the wrong way. The warning message may be suppressed, when the additional information item signals an authorization of the vehicle driving the wrong way to travel in a direction opposite to a normal direction of travel. Thus, for example, an advancing end of a traffic jam may be protected by a police vehicle traveling in reverse. In the same manner, emergency vehicles may intentionally suppress the transmission of the warning message.

This method may be implemented, for example, as software or hardware, or in a combined form of software and hardware, in, for example, a control unit.

The approach put forward here further provides a device, which is configured to perform, control and/or implement the steps of a variant of a method put forward here, in corresponding devices. The object of the present invention may also be achieved quickly and efficiently by this embodiment variant of the present invention in the form of a device.

In the case at hand, a device may be understood as an electrical device that processes sensor signals and outputs control and/or data signals as a function of them. The device may have an interface, which may be implemented as hardware and/or software. In a hardware configuration, the interfaces may, for example, be part of a so-called system ASIC that contains many different functions of the control device. However, it is also possible for the interfaces to be separate, integrated circuits or to be at least partially made up of discrete components. In a software configuration, the interfaces may be software modules that are present, for example, on a microcontroller in addition to other software modules.

Also advantageous is a computer program product or computer program, also called a software program, including program code, which may be stored on a machine-readable carrier or storage medium, such as a solid state memory, a hard disk storage device or an optical storage device, and is used for performing, implementing and/or controlling the steps of the method according to one of the above-described specific embodiments, in particular, when the program product or program is executed on a computer or a device.

Figure 2:
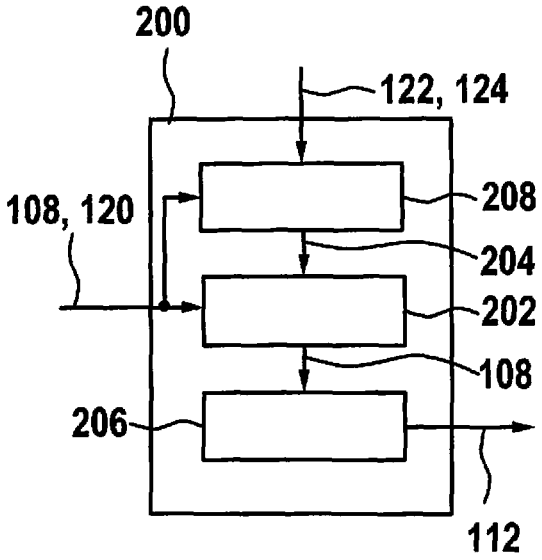
Figure 3:
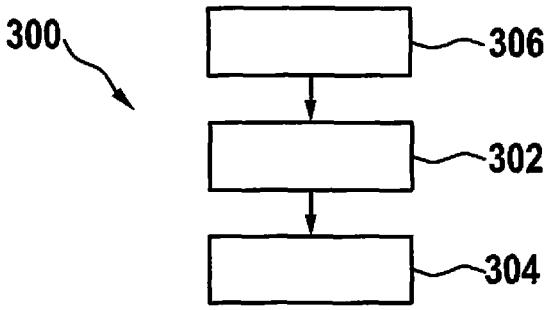

Exemplary embodiments of the present invention are represented in the drawing and explained in greater detail in the following description. The figures show:

FIG. 1 a representation of situations at an exit of an expressway;

FIG. 2 a block diagram of a device for validating an information item regarding a wrong-way driver, according to an exemplary embodiment; and FIG. 3 a flow chart of a method for validating an information item regarding a wrong-way driver, according to an exemplary embodiment.

In the following description of the exemplary embodiments of the present invention, the same or similar reference numerals are used for the elements that are shown in the various figures and function similarly, while a repeated description of these elements is omitted.

FIG. 1 shows a representation of situations at an exit 100 of an expressway 102. In a first situation, a vehicle 104 travels on an exit ramp 106 of expressway exit 100 in a direction opposite to the direction of travel. Due to this, vehicle 104 triggers the detection of a wrong-way driver, and an information item regarding a wrong-way driver 108 is generated. Information item regarding a wrong-way driver 108 is transmitted to a central data processing device 110. Data processing device 110 may be referred to as a server 110 and may be cloud-based, for example. In data processing device 110, information item regarding a wrong-way driver 108 is checked according to an exemplary embodiment of the approach put forward here. Since only an information item regarding a wrong-way driver 108 is present and no additional information item characterizes information item regarding a wrong-way driver 108 as irrelevant, information item regarding a wrong-way driver 108 is transmitted as a warning message 112 to endangered road users 114 and vehicle 104 traveling the wrong way. In this manner, a driver of vehicle 104 traveling the wrong way 104 may be persuaded to stop driving the wrong way prior to reaching expressway 102, which may be while still on exit ramp 106. Endangered road users 114 may adjust their manner of driving, in order to minimize their risk.

In another situation, emergency services rush to the deployment location. The traffic lanes of expressway 102 are blocked in one direction of travel by an accident 116. In order to reach the accident location, emergency vehicles 104, 118 drive onto expressway 102 in a direction opposite to the direction of travel. To that end, emergency vehicles 104, 118 travel on exit ramp 106 of exit 100 in a direction opposite to the direction of travel. In this manner, each of emergency vehicles 104, 118 release an information item regarding a wrong-way driver 108, 120. Information items regarding a wrong-way driver 108, 120 are transmitted to central data processing device 110. In one exemplary embodiment of the approach put forward here, it is recognized in data processing device 110, that the wrong-way driver identification was triggered two times within a brief time window. Since two or more instances of wrong-way travel one after the other, in a short time interval, at the same expressway exit 100 are extremely unlikely, then, using information item regarding a wrong-way driver 108, 120, the additional information item is generated, which characterizes information item regarding a wrong-way driver 108, 120 as irrelevant. Using the additional information item, information item regarding a wrong-way driver 108, 120 is classified as irrelevant by data processing device 110. In this manner, warning message 112 to other road users 114 and to emergency vehicles 104, 118 is suppressed.

In another situation, due to accident 116, an accident message 122 is transmitted to data processing device 110. Accident message 122 signals that expressway 102 is blocked in at least one direction of travel. In one exemplary embodiment, the additional information item is validated by accident message 122, since due to the closure of expressway 102, there can be no dangerous encounter between emergency vehicles 104, 118 and other road users 114.

In another situation, at least one of emergency vehicles 104, 118 has a device for providing an authorization information item 124. For example, authorization information item 124 is transmitted wirelessly to data processing device 110. Authorization information item 124 represents an authorization for emergency vehicle(s) 104, 118 to travel on expressway 102 in a direction opposite to the direction of travel. In one exemplary embodiment, authorization information item 124 is used in data processing device 110, as the additional information item, and characterizes information items regarding a wrong-way driver 108, 120 as irrelevant.

In other words, a method for detecting and suppressing non-relevant warning messages 112 is put forward.

A plausibility check of an output state and generation of a release decision may be carried out in various ways. For example, a release decision may be generated by validating a moving direction of motor vehicle 104 on the basis of data of the traffic monitoring devices.

In the approach put forward here, a subsequent plausibility check is conducted on the basis of historic data. In this manner, instances of false detection and, therefore, the sending of false warning messages to automobile drivers 114 in the vicinity is prevented. Consequently, a low false-positive rate is achieved.

In this manner, false release may be prevented in exceptional situations, such as a detour. A potentially traffic-endangering overreaction due to a false warning to supposedly endangered automobile drivers may be prevented.

To date, a danger situation for a vehicle 104, 114, when vehicle 104, 114 is in the vicinity of a federal expressway entrance 100, has been detected using various detection methods. In this context, the detection may be carried out on the back end 110 by detecting the danger situation using specific algorithms. When the danger situation is detected, a danger message 112 is transmitted to endangered automobile driver 104, 114.

In the case of severe traffic disruptions, such as full closures due to accidents 116, or in special situations such as large-scale events, temporary rerouting of the traffic is often activated. In some cases, this results in deliberate or intentional use of entrances or exits 106 in a direction opposite to the direction of travel normally intended.

Consequently, a wrong-way driver would be mistakenly detected and a false warning subsequently issued due to the detection methods up to now.

In one exemplary embodiment, an efficient method is described, which recognizes the detection of several consecutive warnings regarding a wrong-way driver 108, 120 in a specific period of time. In this manner, the sending of false warning messages is prevented, and consequently, the false-positive rate is minimized.

In one exemplary embodiment, on the back end 110 or server 112, the algorithm detects several warnings 108, 120 on the same federal expressway entrance 100 within a short time. Since it is highly unlikely to detect several wrong-way drivers on the same federal expressway 102 within this time span, it may be assumed that an instance of false detection has occurred. On that basis, the algorithm is deactivated, which means that the sending of a false warning message (false positive) to supposed wrong-way driver 104, 118 and/or to supposedly directly endangered automobile driver 114 is prevented.

This allows a possible panic reaction of the drivers to be prevented. This precautionary measure allows a decision to deactivate the algorithm without the consideration of additional data, such as an accident message 122 from the central traffic control office.

In one exemplary embodiment, an instance of prevention takes place on the part of the vehicle entering in the wrong direction 104, 118. In this case, vehicle 104, 118 may be referred to as a client. A warning message 108, 120, which is present on server 110, relates to what is present on the entrance and exit 100 traveled on by vehicle 104, 118, i.e., the client, and/or which relates to the entrance or exit 100 traveled on by vehicle 104, 118, is detected via a communications interface. If warning message 108, 120 was detected immediately or a short period of time prior to using entrance and exit 100, then communication may be prevented.

For example, in the case of rerouting the traffic flow in special situations, several vehicles 104, 118 travel in a direction opposite to the foreseen direction of travel. In this manner, the detection of a further warning message is prevented. Therefore, even in this case, a panic reaction may be prevented.

In one prevention scenario, direct communication with the server may be prevented, in that data for a warning-message plausibility check or a warning message itself, which was detected by the vehicle, i.e., client, is not transmitted to server 110.

In one prevention scenario, the communication between two vehicles 104, 114 or clients is prevented, in that a warning message 108, which was detected by vehicle 104, is not transmitted to endangered drivers 114.

In one exemplary embodiment, additional information items 122 of the central traffic control office and/or of the police are considered for checking the plausibility of the calculation regarding a wrong-way driver. Information items, such as the position of an accident, an event, or a detour, allow an analysis of the nearest entrances and exits 100, which are additionally considered in the calculation regarding a wrong-way driver for checking plausibility. In addition, a preventive measure is possible, in that the algorithm for the corresponding entrances and exits 100 is deactivated early in an automatic or manual manner.

Scenarios, in which an instance of false detection may occur, include, for example, when emergency services 104, 118 must travel on a federal expressway entrance 100 in a direction opposite to the direction of travel, in order to reach deployment location 116 as rapidly as possible. This results in repeated instances of detection 108, 120.

Due to an accident 116 or an event, a detour is set up in order to allow the traffic to flow. In this context, the traffic flow is routed against the direction of travel, via a federal expressway entrance ramp 100. This produces repeated instances of detection 108, 120 within a very short period of time.

FIG. 2 shows a block diagram of a device 200 for validating an information item regarding a wrong-way driver 108, according to an exemplary embodiment. In this context, information item regarding a wrong-way driver 108 indicates a detected instance of wrong-way travel of a vehicle traveling the wrong way, as is represented in FIG. 1. Device 200 may be, for example, a component of the data processing device in FIG. 1. Device 200 may also be situated in a vehicle.

In one exemplary embodiment, device 200 includes a device 202 for checking plausibility. Device 202 for checking plausibility is configured to check the plausibility of information item regarding a wrong-way driver 108, using an additional information item 204, before information item regarding a wrong-way driver 108 is made available as a warning message 112 for affected road users, using a device 206 for retrieving. In this context, warning message 112 is suppressed, if additional information item 204 characterizes information item regarding a wrong-way driver 108 as irrelevant.

In one exemplary embodiment, device 200 includes a device 208 for generating additional information item 204. Device 208 for generating is configured to generate additional information item 204 as characterizing irrelevancy, when information item regarding a wrong-way driver 108 and at least one further information item regarding a wrong-way driver 120 have been acquired within a predefined time window. The additional information item may be further validated, in that additional information item 204 is generated as characterizing irrelevancy, when information items regarding a wrong-way driver 108, 120 have been further detected, using the same methods for detecting a wrong-way driver, and/or using the same detection device. Furthermore, the additional information item may be validated, in that additional information item 204 is generated as characterizing irrelevancy, when information items regarding a wrong-way driver 108, 120 have further been detected at the same location, for example, at the same exit.

In one exemplary embodiment, device 208 for generating is configured to evaluate further input variables 122, 124, in order to generate additional information item 204. For example, an accident information item 122, a detour information item, a traffic information item, and/or an authorization information item 124 may be inputted, in order to generate additional information item 204. The traffic information item and/or the detour information item may characterize information item regarding a wrong-way driver 204 as irrelevant, when information item regarding a wrong-way driver 108, 120 has been detected in a section of road, which has been identified by the traffic information item and/or by the detour information item as having to be traveled on in a direction opposite to a normal direction of travel.

FIG. 3 shows a flowchart of a method 300 for validating an information item regarding a wrong-way driver, according to an exemplary embodiment. Method 300 may be executed, for example, on a device for validating, as is represented in FIG. 2. In one exemplary embodiment, method 300 includes a step 302 of checking plausibility and a step 304 of retrieving. In step 302 of checking plausibility, the information item regarding a wrong-way driver is checked for plausibility, using an additional information item, before, in step 304 of retrieving, the information item regarding a wrong-way driver is made available as a warning message for affected road users. In this context, the warning message is suppressed when the additional information item characterizes the information item regarding a wrong-way driver as irrelevant.

In one exemplary embodiment, the method includes a step 306 of generating. In step 306 of generating, the additional information item is generated as characterizing irrelevancy, when the information item regarding a wrong-way driver and at least one further information item regarding a wrong-way driver have been acquired within a predefined time window.

In other words, FIG. 3 shows a flowchart of a method 300 for detecting cases, in which an otherwise valid traffic warning message is irrelevant on the basis of temporary changes to the traffic routing. In this context, the detection may be carried out by discovering the implausibly frequent occurrence of a warning event. In the same way, the detection may additionally be checked for plausibility, using further information items, such as an accident message, a traffic jam message or a detour recommendation.

If an exemplary embodiment includes an "and/or" conjunction between a first feature and a second feature, then this is to be understood to mean that according to one specific embodiment, the exemplary embodiment includes both the first feature and the second feature, and according to a further specific embodiment, the exemplary embodiment includes either only the first feature or only the second feature.

What is claimed is:

1. A method for validating an information item regarding a wrong-way driver, which indicates an instance of detected wrong-way travel of a vehicle driving the wrong way, the method comprising:

receiving, by a central data processing device from a first vehicle, an information item regarding a wrong-way driver;

checking, by the central data processing unit, the received information item regarding the wrong-way driver for plausibility, using an additional information item, before the information item regarding the wrong-way driver is made available as a warning message for affected road users;

suppressing the warning message if the additional information item characterizes the information item regarding the wrong-way driver as irrelevant; and transmitting the warning message, by the central processing unit, to at least one affected road user other than the first vehicle, if the plausibility check does not indicate the information item regarding the wrong-way driver as irrelevant.

2. The method of claim 1, further comprising:

generating, by the central data processing unit, the additional information item as characterizing irrelevancy, when the information item regarding the wrong-way driver and at least one further received information item regarding another wrong-way driver have been detected within a predefined time window.

3. The method of claim 2, wherein in the generating, the additional information item is generated as characterizing irrelevancy, if the information items regarding the wrong-way driver have further been detected, using the same methods for detecting the wrong-way driver.

4. The method of claim 2, wherein in the generating, the additional information item is generated as characterizing irrelevancy, if the information items regarding the wrong-way driver have further been detected at the same location.

5. The method of claim 1, wherein in the checking of the plausibility, the additional information item represents a traffic information item; the traffic information item characterizing the information item regarding the wrong-way driver as irrelevant, when the information item regarding the wrong-way driver has been detected in a section of road, which has been identified by the traffic information item as having to be traveled on in a direction opposite to a normal direction of travel.

6. The method of claim 1, further comprising:

inputting the additional information item if a vehicle is traveling the wrong way; and in the checking of the plausibility, suppressing the warning message if the additional information item signals an authorization of the vehicle traveling the wrong way to travel in a direction opposite to a normal direction of travel.

7. A device for validating an information item regarding a wrong-way driver, which indicates an instance of detected wrong-way travel of a vehicle driving the wrong way, comprising:

a central data processing device that receive, from a first vehicle, an item of information regarding a wrong-way driver;

wherein the central data processing device include a checking arrangement to check the received information item regarding the wrong-way driver for plausibility, using an additional information item, before the information item regarding the wrong-way driver is made available as a warning message for affected road users;

wherein the central data processing device includes a suppressing arrangement to suppress the warning message if the additional information item characterizes the information item regarding the wrong-way driver as irrelevant; and the central data processing device transmits the warning message to at least one affected road user other than the first vehicle if the plausibility check does not indicate the information item regarding the wrong-way driver as irrelevant.

8. A non-transitory computer readable medium having a computer program, which is executable by a processor, comprising:

a program code arrangement having a program code for validating an information item regarding a wrong-way driver, which indicates an instance of detected wrong-way travel of a vehicle driving the wrong way, by performing the following:

receiving, by a central data processing device from a first vehicle, an information item regarding a wrong-way driver;

checking, by the central data processing device, the received information item regarding the wrong-way driver for plausibility, using an additional information item, before the information item regarding the wrong-way driver is made available as a warning message for affected road users;

suppressing the warning message if the additional information item characterizes the information item regarding the wrong-way driver as irrelevant; and transmitting the warning message, by the central data processing device, to at least one affected road user other than the first vehicle, if the plausibility check does not indicate the information item regarding the wrong-way driver as irrelevant.

9. The device of claim 7, wherein the additional information item is generated as characterizing irrelevancy, when the information item regarding the wrong-way driver and at least one further information item regarding a wrong-way driver have been detected within a predefined time window.

10. The method of claim 1, wherein the at least one affected road user includes a second vehicle that is the wrong-way driver.

11. The device of claim 7, wherein the at least one affected road user includes a second vehicle that is the wrong-way driver.

12. The non-transitory computer readable medium of claim 8, wherein the at least one affected road user includes a second vehicle that is the wrong-way driver.

13. The method of claim 1, wherein the central data processing device is a cloud-based server.

14. The device of claim 7, wherein the central data processing device is a cloud-based server.

15. The method of claim 1, wherein the central data processing device transmits the warning message wirelessly to the at least one affected road user.

16. The device of claim 7, wherein the central data processing device transmits the warning message wirelessly to the at least one affected road user.

17. The method of claim 1, wherein the warning message is suppressed if the additional information item characterizes the information item regarding the wrong-way driver as authorized to travel in a direction opposite to a normal direction of travel.

18. The device of claim 7, wherein the warning message is suppressed if the additional information item characterizes the information item regarding the wrong-way driver as authorized to travel in a direction opposite to a normal direction of travel.

19. The method of claim 1, wherein the warning message is suppressed if the central data processing device receives information items regarding a plurality of different wrong-way drivers within a predetermined period of time.

20. The device of claim 7, wherein the warning message is suppressed if the central data processing device receives information items regarding a plurality of different wrong-way drivers within a predetermined period of time.

* * * * *